US011027801B2

(12) United States Patent
Barnes et al.

(10) Patent No.: US 11,027,801 B2
(45) **Date of Patent: *Jun. 8, 2021**

(54) BOAT LIFT

(71) Applicant: Sea Power Boat Lifts, LLC, Mt. Pleasant, SC (US)

(72) Inventors: Sean A. Barnes, Mt. Pleasant, SC (US); Michael W. Kirby, Mt. Pleasant, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/793,424

(22) Filed: Feb. 18, 2020

(65) Prior Publication Data

US 2020/0180738 A1 Jun. 11, 2020

Related U.S. Application Data

(63) Continuation of application No. 16/238,849, filed on Jan. 3, 2019, now Pat. No. 10,597,127, which is a continuation-in-part of application No. 16/143,737, filed on Sep. 27, 2018, now Pat. No. 10,370,073, which is a continuation of application No. 15/467,399, filed on Mar. 23, 2017, now Pat. No. 10,086,919, which is a continuation-in-part of application No. 15/160,372, filed on May 20, 2016, now Pat. No. 9,604,709.

(51) Int. Cl.

| | |
|---|---|
| ***B63C 3/06*** | (2006.01) |
| ***B63C 1/06*** | (2006.01) |
| ***B63C 1/02*** | (2006.01) |

(52) U.S. Cl.

CPC ..... *B63C 1/06* (2013.01); *B63C 1/02* (2013.01); *B63C 3/06* (2013.01)

(58) Field of Classification Search

CPC ..... B63C 1/02; B63C 1/06; B63C 3/06
USPC ..... 405/1, 3, 4
See application file for complete search history.

(56) References Cited

U.S. PATENT DOCUMENTS

| | | | | |
|---|---|---|---|---|
| 3,270,698 A | | 9/1966 | Fort | |
| RE27,090 E | | 3/1971 | Rutter | |
| 3,603,276 A | | 9/1971 | De Lisle | |
| 3,727,415 A | | 4/1973 | Williams | |
| 3,895,592 A | * | 7/1975 | King | B63C 1/02 114/45 |
| 3,916,811 A | * | 11/1975 | Fromnick | B63B 39/03 114/125 |
| 3,967,570 A | | 7/1976 | Bradfield | |
| 4,018,179 A | | 4/1977 | Rutter | |
| 4,072,119 A | | 2/1978 | Williams | |

(Continued)

FOREIGN PATENT DOCUMENTS

| | | | |
|---|---|---|---|
| FR | 3017595 | * | 8/2015 |
| WO | WO2014035026 | | 3/2014 |

OTHER PUBLICATIONS

Shoremaster, LLC, Official RhinoHoist Front Mount Floating Boat Lift Video, YouTube, May 10, 2013, https://www.youtube.com/watch?v=ayxgoTHCijl.

*Primary Examiner* — Frederick L Lagman
(74) *Attorney, Agent, or Firm* — B. Craig Killough

(57) ABSTRACT

A boat lift has one or more pumps that evacuate water from a first flotation tank construct and a second flotation tank construct to create flotation of the boat lift. Modular boat lifts may be constructed according to the invention that have substantial size but are transportable by truck for construction on site.

18 Claims, 17 Drawing Sheets

(56) References Cited

U.S. PATENT DOCUMENTS

| | | | | |
|---|---|---|---|---|
| 4,276,849 | A | 7/1981 | Bloxham | |
| 4,280,429 | A | 7/1981 | Wells | |
| 4,510,877 | A | 4/1985 | Bloxham | |
| 4,641,595 | A | 2/1987 | Pritchett | |
| 4,763,592 | A | 8/1988 | Russ | |
| 4,782,778 | A | 11/1988 | Barbaglia | |
| 5,002,000 | A | 3/1991 | Rutter | |
| 5,016,551 | A | 5/1991 | Peck et al. | |
| 5,115,753 | A * | 5/1992 | Craddock | B63C 1/06 114/48 |
| 5,131,342 | A * | 7/1992 | Sackett | B63C 1/02 114/344 |
| 5,140,922 | A | 8/1992 | Bowman et al. | |
| 5,394,814 | A | 3/1995 | Rutter et al. | |
| 5,549,070 | A | 8/1996 | Cruchelow et al. | |
| 5,664,513 | A | 9/1997 | Echelbarger | |
| 5,826,528 | A | 10/1998 | Jancsek | |
| 5,860,379 | A | 1/1999 | Moody | |
| 5,860,765 | A | 1/1999 | Cruchelow et al. | |
| 6,477,968 | B2 | 11/2002 | Powell | |
| 6,526,902 | B1 | 3/2003 | Faber | |
| 6,547,485 | B2 | 4/2003 | Elson | |
| 6,848,380 | B1 * | 2/2005 | Sainz | B63C 1/04 114/49 |
| 8,267,621 | B1 | 9/2012 | Way | |
| 9,132,897 | B2 | 9/2015 | Barnes et al. | |
| 9,352,812 | B1 | 5/2016 | Barnes et al. | |
| 9,604,709 | B2 | 3/2017 | Barnes | |
| 10,086,919 | B2 | 10/2018 | Barnes | |
| 10,370,073 | B2 * | 8/2019 | Barnes | B63C 1/06 |
| 10,597,127 | B2 * | 3/2020 | Barnes | B63C 1/06 |
| 2001/0015163 | A1 * | 8/2001 | Powell | B63C 1/04 114/46 |
| 2002/0131821 | A1 | 9/2002 | Elson | |
| 2006/0156964 | A1 | 7/2006 | Canniffe et al. | |
| 2006/0278154 | A1 * | 12/2006 | Towley, III | B63C 13/00 114/264 |
| 2007/0000425 | A1 * | 1/2007 | Towley, III | B63C 13/00 114/344 |
| 2008/0008528 | A1 * | 1/2008 | Hey | B66C 1/62 405/3 |
| 2008/0276851 | A1 | 11/2008 | Weed | |
| 2008/0306642 | A1 | 12/2008 | Figura et al. | |
| 2009/0162145 | A1 * | 6/2009 | Fogarty | E02C 1/02 405/86 |
| 2009/0235857 | A1 | 9/2009 | Hodapp | |
| 2011/0146554 | A1 | 6/2011 | Wright et al. | |
| 2011/0277675 | A1 | 11/2011 | Thom et al. | |
| 2014/0010593 | A1 | 1/2014 | Davis | |

* cited by examiner

BOAT LIFT

This Application is a continuation of application Ser. No. 16/238,849 filed Jan. 3, 2019, now U.S. Pat. No. 10,597,127, issued Mar. 24, 2020, which was a continuation in part of U.S. application Ser. No. 16/143,737, filed Sep. 27, 2018, U.S. Pat. No. 10,370,073 issued Aug. 6, 2019, which is a continuation of U.S. application Ser. No. 15/467,399, filed Mar. 23, 2017, U.S. Pat. No. 10,086,919 issued Oct. 2, 2018, which is a continuation in part of U.S. application Ser. No. 15/160,372, filed May 20, 2016, U.S. Pat. No. 9,604,709 issued Mar. 25, 2017.

BACKGROUND OF THE INVENTION

It is desirable to store boats out of the water when not in use. Particularly in saltwater environments, water can lead to rapid corrosion of metal parts, and depreciation of other parts of the boat. Further, in many saltwater environments, storage of the boat hull in the water leads to fouling of the hull, propellers and through hulls that communicate with boat utilities. Barnacle growth, for example, occurs in many saltwater environments, and such fouling reduces performance of the boat hull and propulsion systems.

It is also desirable to lift boats out of the water for maintenance.

Many boats and ships are very large. There is a need for boat lifts that can accommodate larger vessels, and can be transported on highways for installation in water, without obtaining special permits due to the width and/or length of the transported boat lift.

SUMMARY OF THE INVENTION

A boat lift has one or more pumps that evacuate water from a first flotation tank construct and a second flotation tank construct to create flotation of the boat lift. Modular boat lifts may be constructed according to the invention that have substantial width while being transportable by truck for assembly on site.

BRIEF DRAWING DESCRIPTION

DESCRIPTION OF PREFERRED EMBODIMENTS

Figure 1:
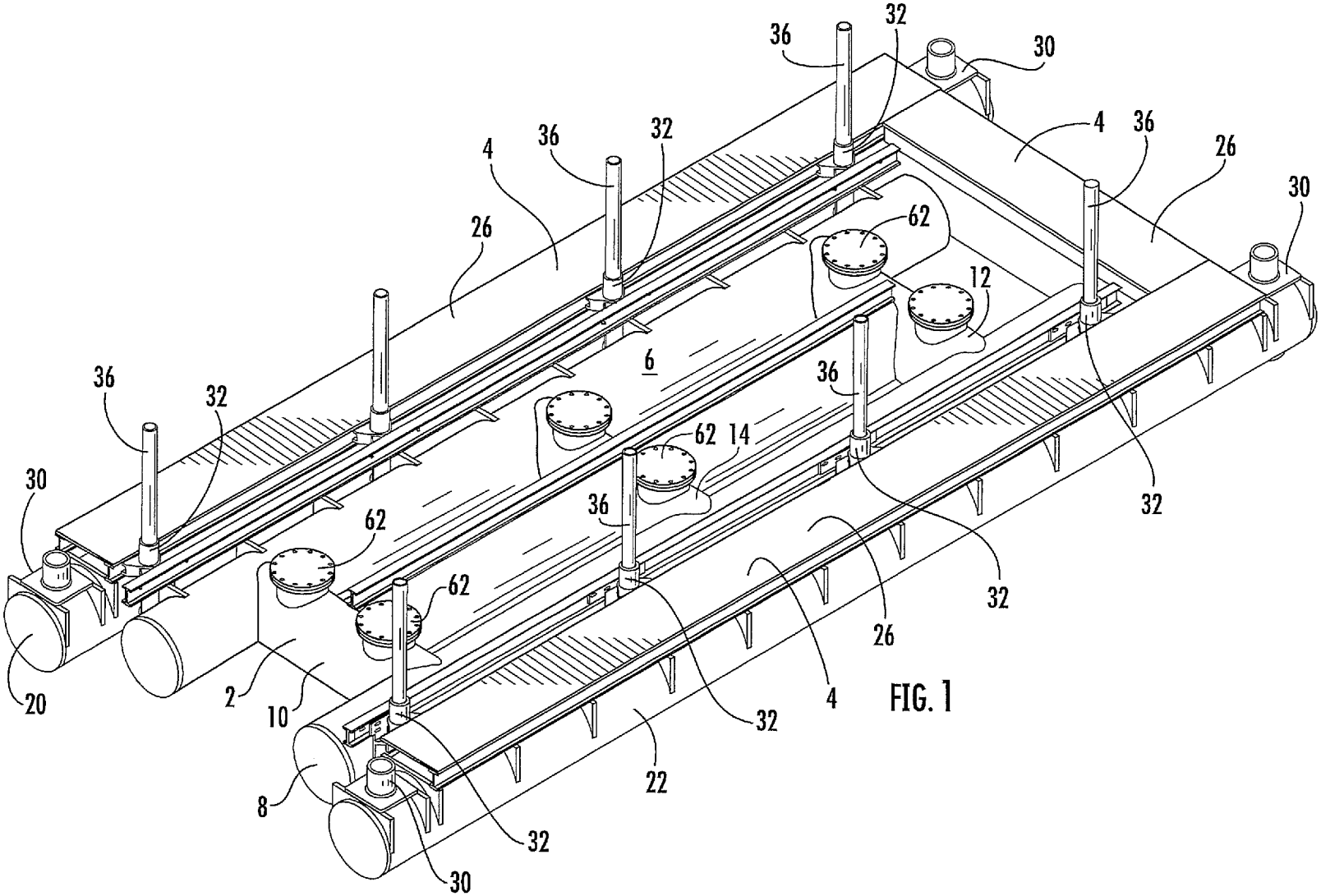
FIG. 1 is a perspective view of a boat lift and catwalk according to an embodiment of the invention.
Figure 2:
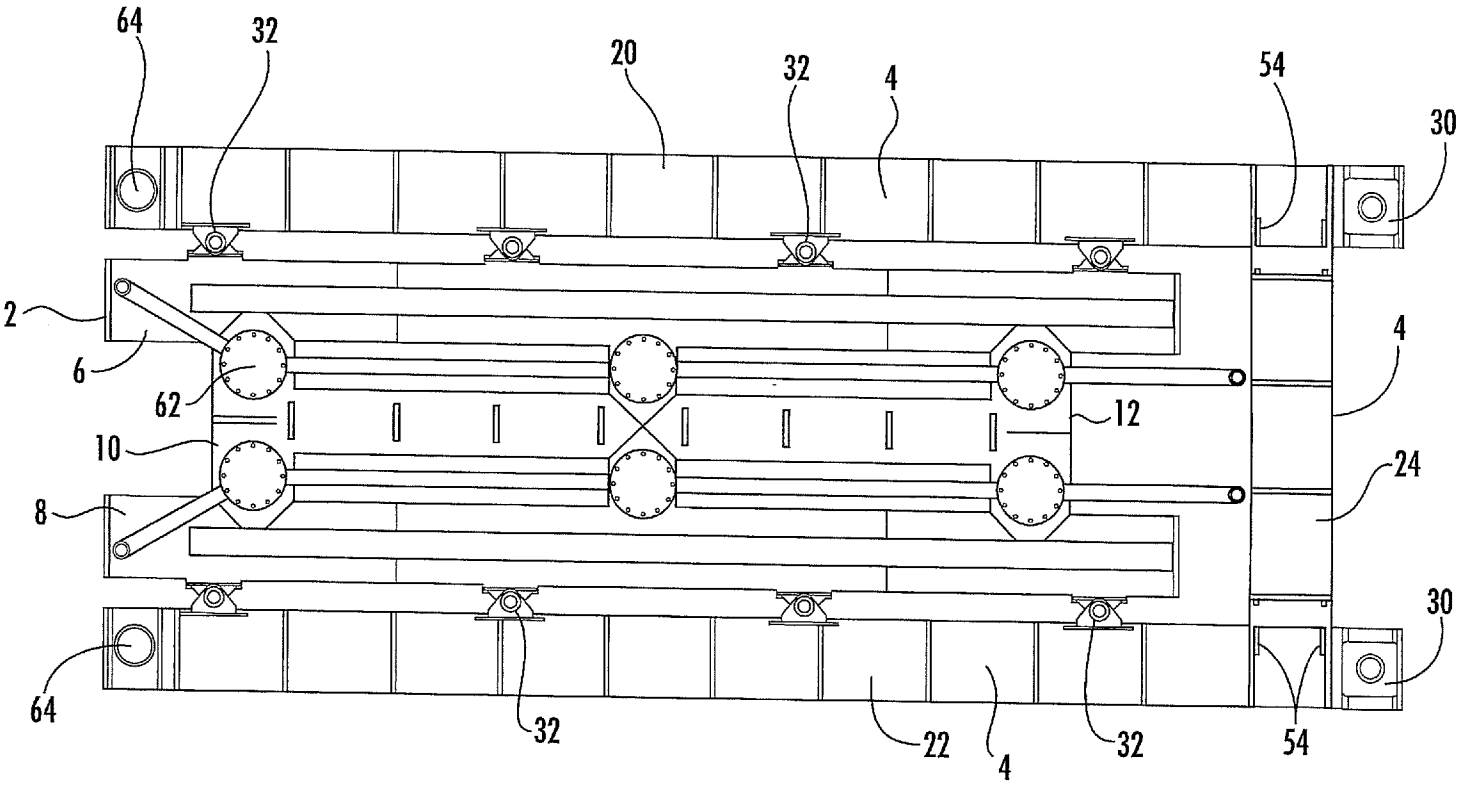
FIG. 2 is a top plan view of the boat lift and catwalk of FIG. 1.

FIG. 1 and FIG. 2 show a preferred embodiment of a boat lift 2 surrounded by a catwalk 4. In this embodiment, the boat lift is characterized by two generally parallel flotation tanks 6,8 that are connected by transverse tanks 10,12 positioned near each end of the longitudinal flotation tanks and may be intermediately positioned 14.

In this embodiment, the boat lift 2 is disposed within a catwalk 4. The catwalk as shown in FIG. 1 and FIG. 2 has generally parallel flotation tanks 20,22 joined at one end by a transverse tank 24. The catwalk is open at one end to permit ingress and egress of a boat from the boat lift.

Figure 3:
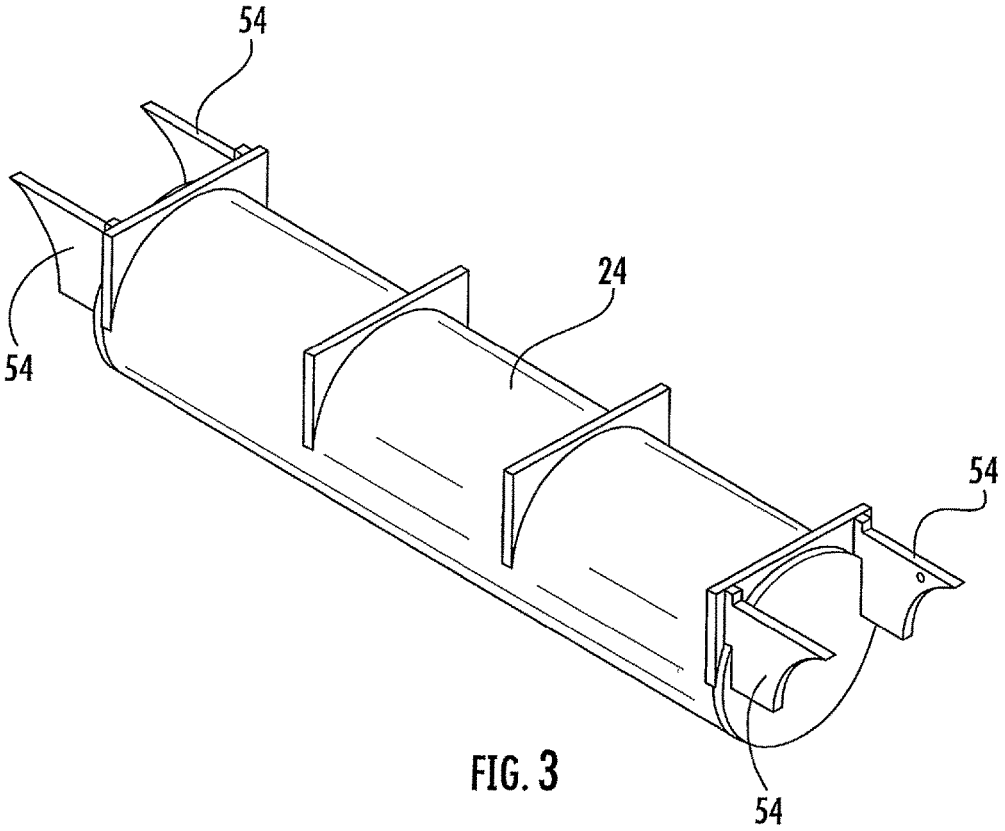
FIG. 3 is a perspective view of a modular section of a boat lift according to an embodiment of the invention.
Figure 4:
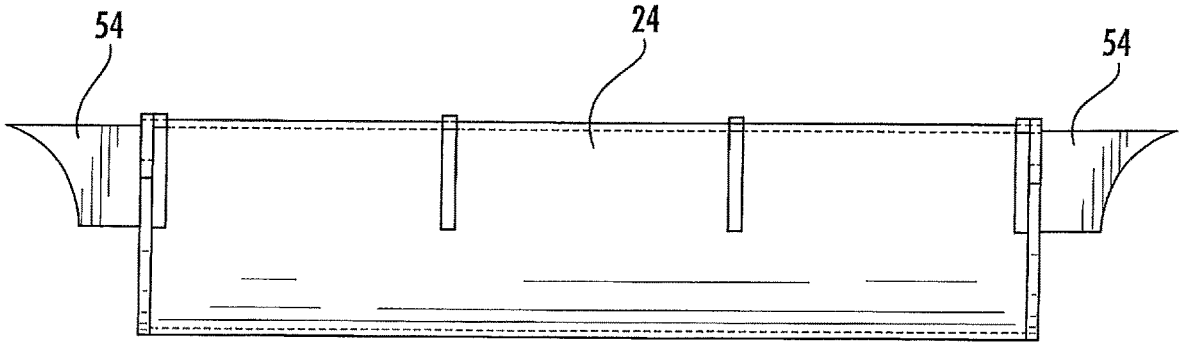
FIG. 4 is an elevation of the modular section of FIG. 3.

FIG. 3 and FIG. 4 show an embodiment of a transverse member 24 for joining the parallel flotation tanks 20, 22 of the catwalk. This transverse member may be formed to a desired length, which is determined based upon the desired width of the boat lift and catwalk. The flanges 54 on the ends of the transverse member or tank may be inserted into slots formed in the catwalk flotation tanks and fixed in place, such as by welding. Assembly may be performed after transportation of the catwalk to the site of installation. As with other embodiments described herein, flotation tanks and other members of the boat lift and the catwalk may be formed in multiple sections for later assembly at the point of installation, along with the transverse member or tank for the catwalk being attached to the flotation tanks of the catwalk after transportation and at the point of installation, allow a boat lift and associated catwalk of large length and/or width to be constructed without concern for highway transportation limitations.

The catwalk 4 floats with a water level of a body of water in which the construct is placed. The flotation tanks may be filled with water to a level that positions the catwalk at a desired height. As the water level of the body of water rises and falls, the catwalk will also rise and fall. The catwalk is secured by piles that are driven into the earth. The piles are generally vertical members that are inserted through pile guides 30.

Figure 5:
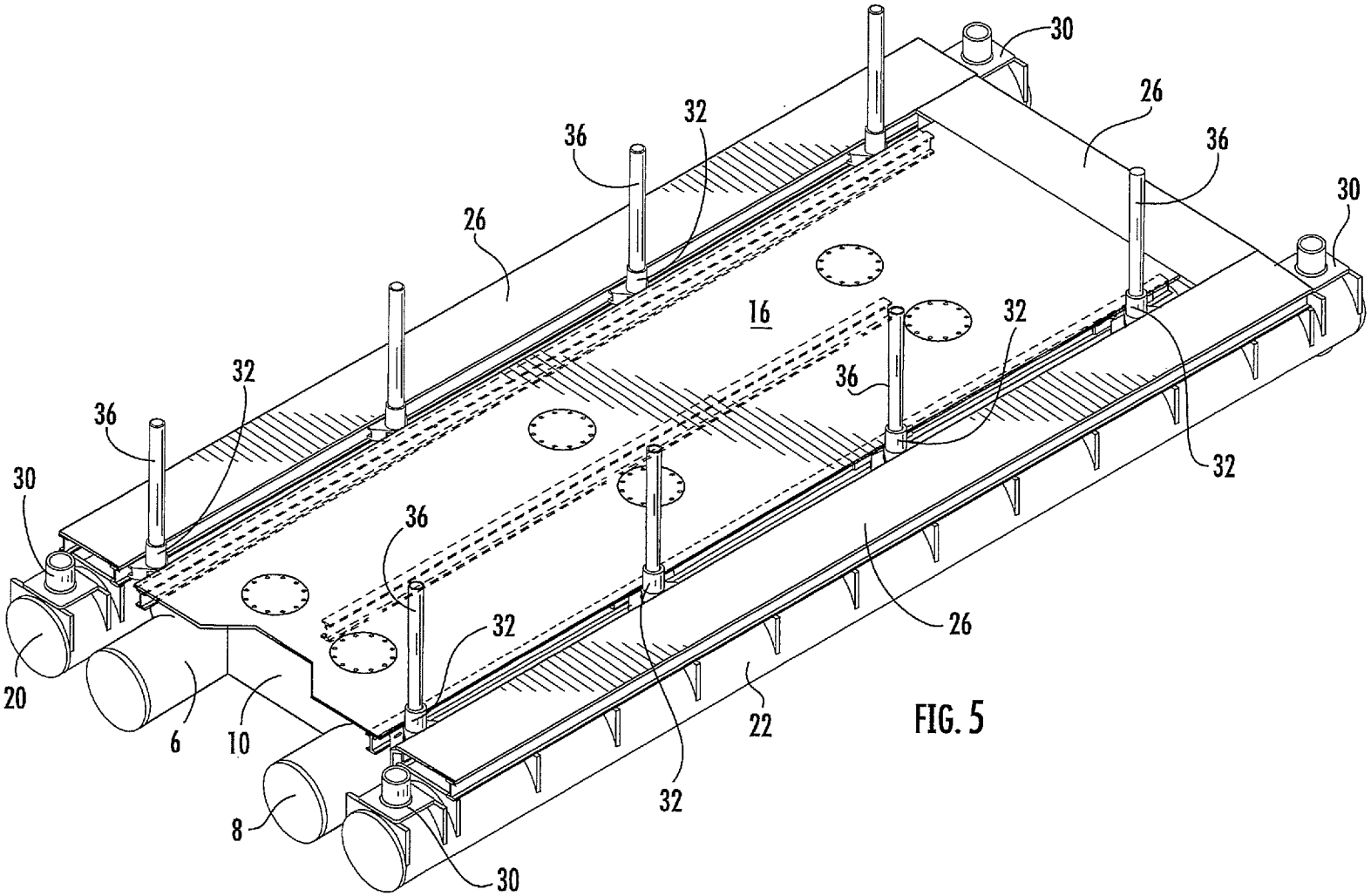
FIG. 5 is a perspective view of the boat lift and catwalk as shown in FIG. 3, with the boat lift and catwalk covered according to an embodiment for use.

In the embodiment as shown in FIG. 1, the pile guides 30 are inserted into voids formed in the flotation tanks. The pile guides are preferred to be positioned at the ends of the flotation tanks 22,24 as shown, so that they are out of the way of covering or planking 26 that covers the catwalks, and do not interfere with the person walking on the catwalk. As shown in FIG. 5, the boat lift 2 may be covered with a covering or planking 16.

The boat lift 2 is secured by a connecting guide construct 32 that is attached to the catwalk 4 in a preferred embodiment. In another embodiment, the connecting guide construct is connected to the boat lift, and if a catwalk is not used, the connecting guide construct is attached to a stationary member such as a pile, or a bulkhead, or a seawall.

Figure 6:
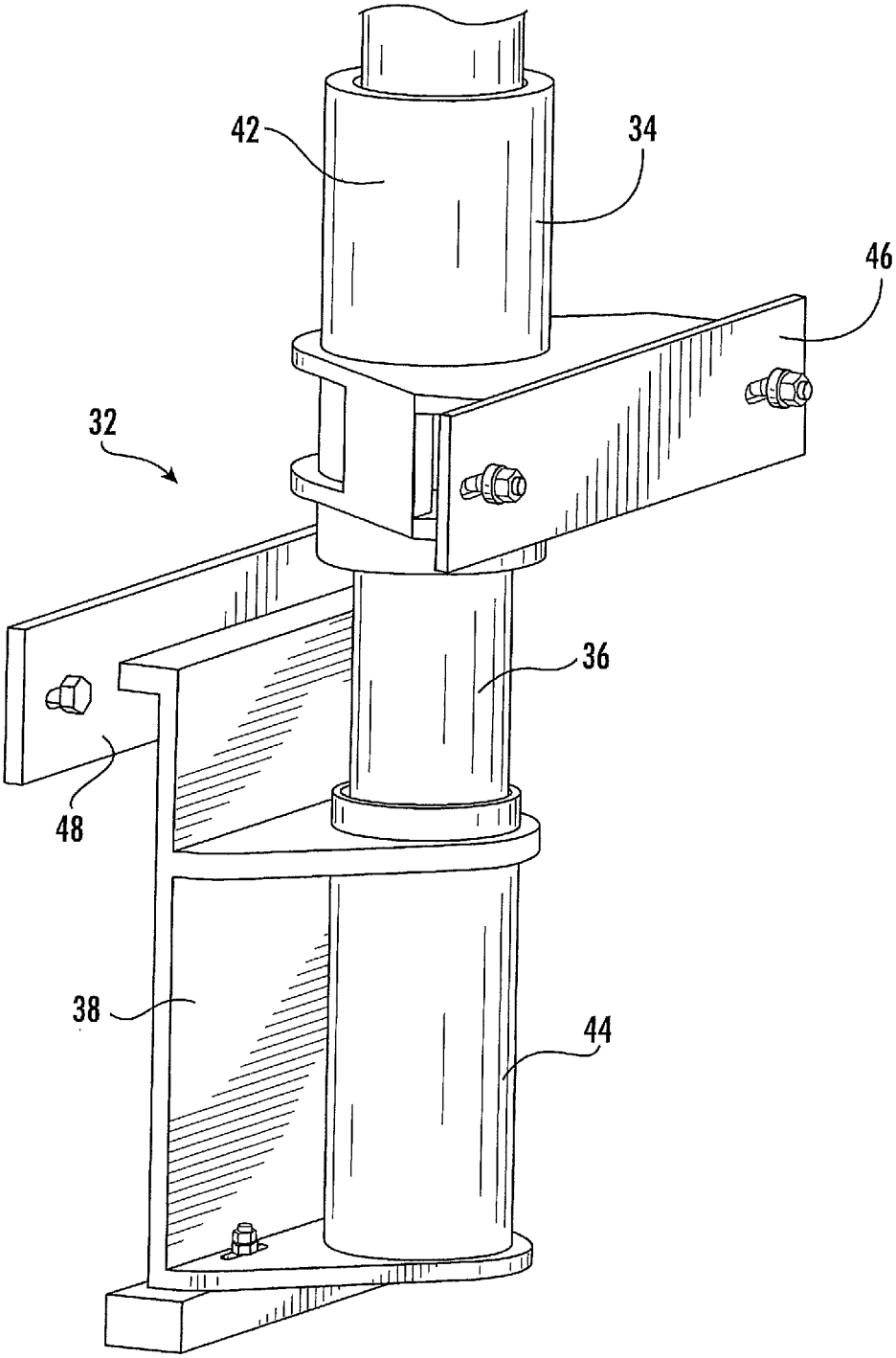
FIG. 6 is an elevation of a connecting guide construct for connecting the floating lift of the invention to a catwalk or other object.
Figure 7:
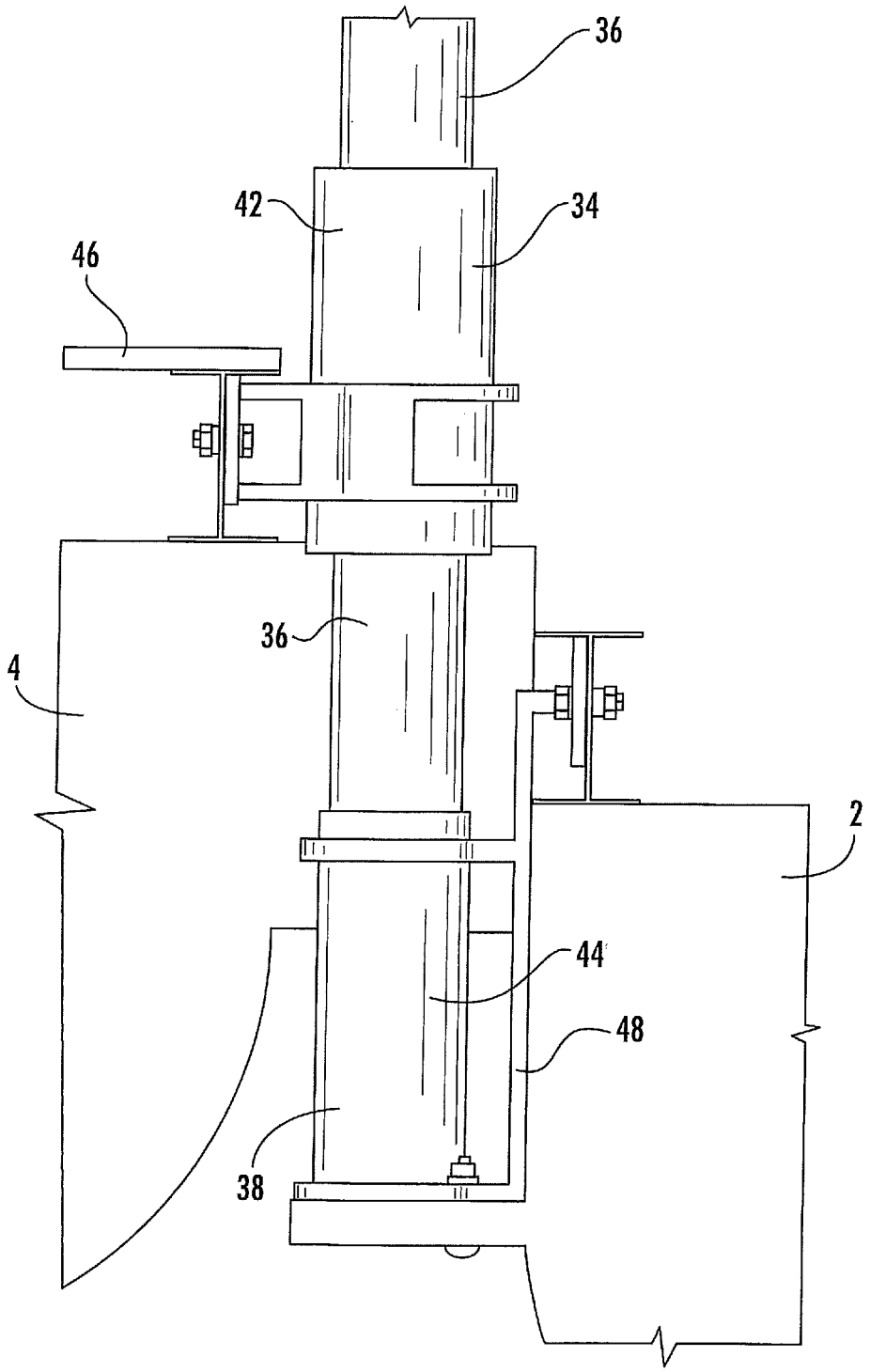
FIG. 7 is an elevation of the connecting guide construct of FIG. 6.

An embodiment of a connecting guide construct is shown in FIG. 6 and FIG. 7. The upper guide 34 is attached to the catwalk 4 or other fixed object. The upper guide vertically traverses the stanchion 36 of the construct. The boat lift guide 38 is attached to the boat lift.

In one embodiment, the boat lift guide 38 and the accompanying stanchion 36 are fixed to the boat lift 2. In another embodiment, the stanchion is driven as a pile into the earth, and the boat lift guide moves vertically along the stanchion as does the upper guide. The use of multiple guide constructs 32 allows the boat lift to raise and lower vertically relative to the catwalk 4. FIG. 1. The catwalk floats vertically with the water level relative to the stanchion. The stanchion fits within the upper guide with very little "slop." The upper guide moves freely in a vertical direction, but the fit with the stanchion inhibits horizontal movement of the upper guide relative the stanchion. Accordingly, the catwalk (or a fixed member) resists horizontal movement from waves, wind and other forces.

Similarly, when the boat lift guide 38 is fixed to the stanchion 36, the boat lift can move vertically, but the horizonal movement of the boat lift 2 is inhibited. If the stanchion is driven as a pile into the earth, the stanchion fits within the upper guide 34 with very little "slop." The upper guide moves freely in a vertical direction, but the fit of the boat lift guide with the stanchion inhibits horizontal movement. Accordingly, the boat lift resists horizontal movement from waves, wind and other forces.

When at least two connecting guide constructs 32 are associated with each flotation tank and are spaced apart as shown in the drawing figures, the boat lift and the catwalk resist horizontal forces applied by wave action, wind and other forces. The boat lift and catwalk are very stable, although they move vertically as the water level raises and lowers in the case of the catwalk, or the boat lift is raised or lowered.

As shown, the boat lift guide 38 and the upper guide 34 of the boat lift construct each comprise a sleeve 42,44. In a preferred embodiment, the sleeves are formed of high density polyethylene. High density polyethylene is extremely strong but has a low co-efficient of friction that allows movement of the guides relative to the stanchion 36. High density polyethylene (HDPE) can be formed to an inside diameter that has minimal slop relative to the stanchion to inhibit horizontal movement, but the co-efficient of friction is sufficiently low to permit the required vertical movement. High density polyethylene is also resistant to corrosion, which is particularly important in saltwater applications.

The guides 34,38 each have a mounting bracket 46,48 that is configured for mounting to the boat lift in the case of the boat lift guide, or to a catwalk in the case of the upper guide as attached to a catwalk, or otherwise configured as required for attachment to a fixed object.

Figure 8:
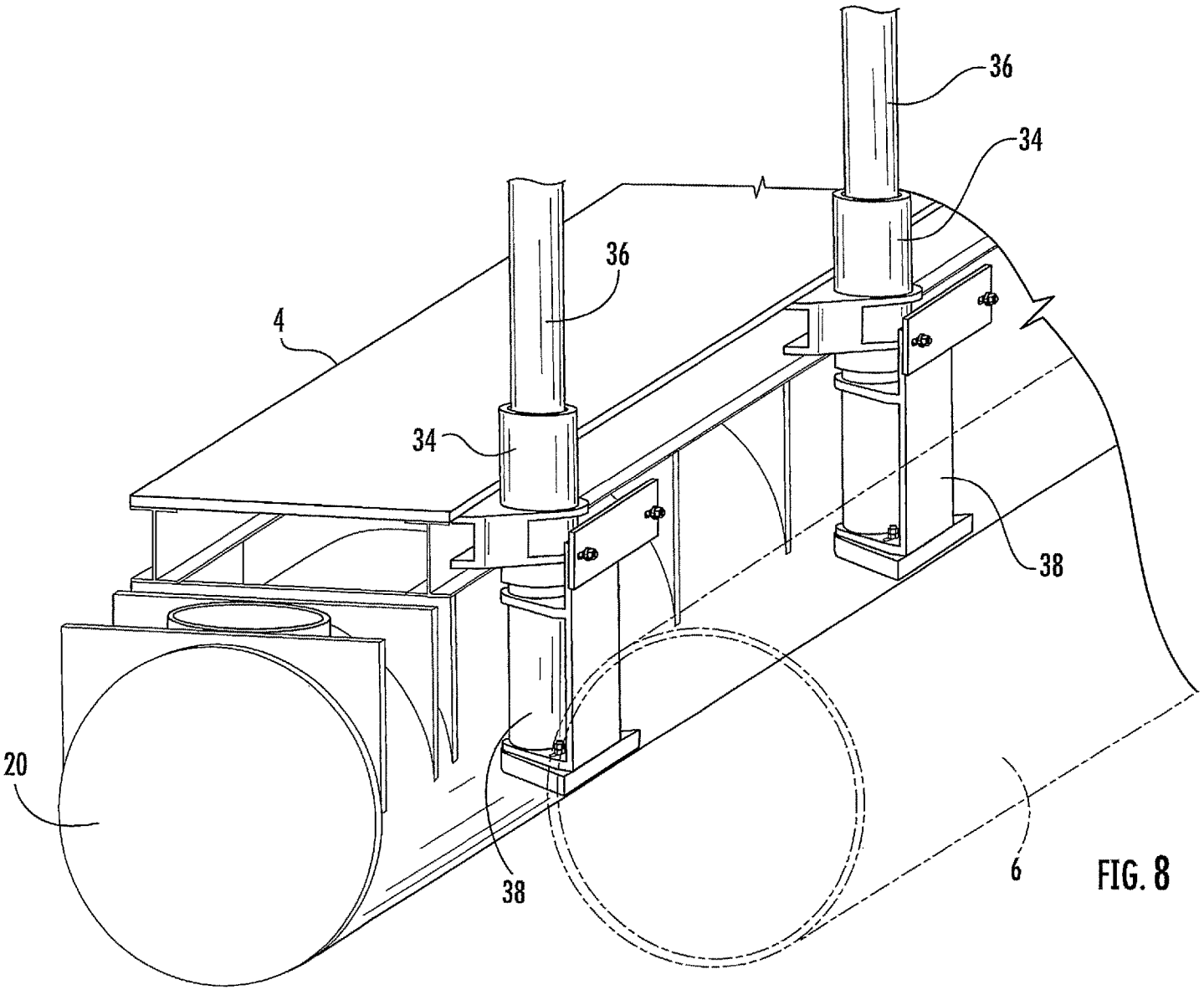
FIG. 8 is a perspective view demonstrating the connecting guide construct of FIG. 8 connecting a boat lift and catwalk.

FIG. 8 shows the connecting guide construct attached to a flotation tank 20 of a catwalk and a flotation tank 6 of a boat lift. The upper guide 34 is attached to flotation tank 20, and the boat lift guide 38 is attached to the flotation tank 6. In the embodiment of FIG. 7, the stanchion 36 is fixed to the boat lift guide. As can be seen, the boat lift can move vertically and independently of the catwalk, and the catwalk can move vertically and independently of the boat lift, each moving substantially only vertically to produce a stable boat lift and catwalk construct even when horizontal forces from wave action, wind, or other horizontal forces are applied to the boat lift and catwalk construct.

The boat lift guide 38 and upper guide 34 may be formed entirely of one material, and preferably HDPE. In another embodiment, the guide sleeves 42,44 are attached to mounting brackets 46,48, which may be formed of metal or other strong and durable materials. The boat lift guide and the upper guide may be mounted to the boat lift and catwalk (or other fixed object) by bolting or in the case of HDPE, welding to the flotation tanks that are preferred to be formed of HDPE.

Figure 9:
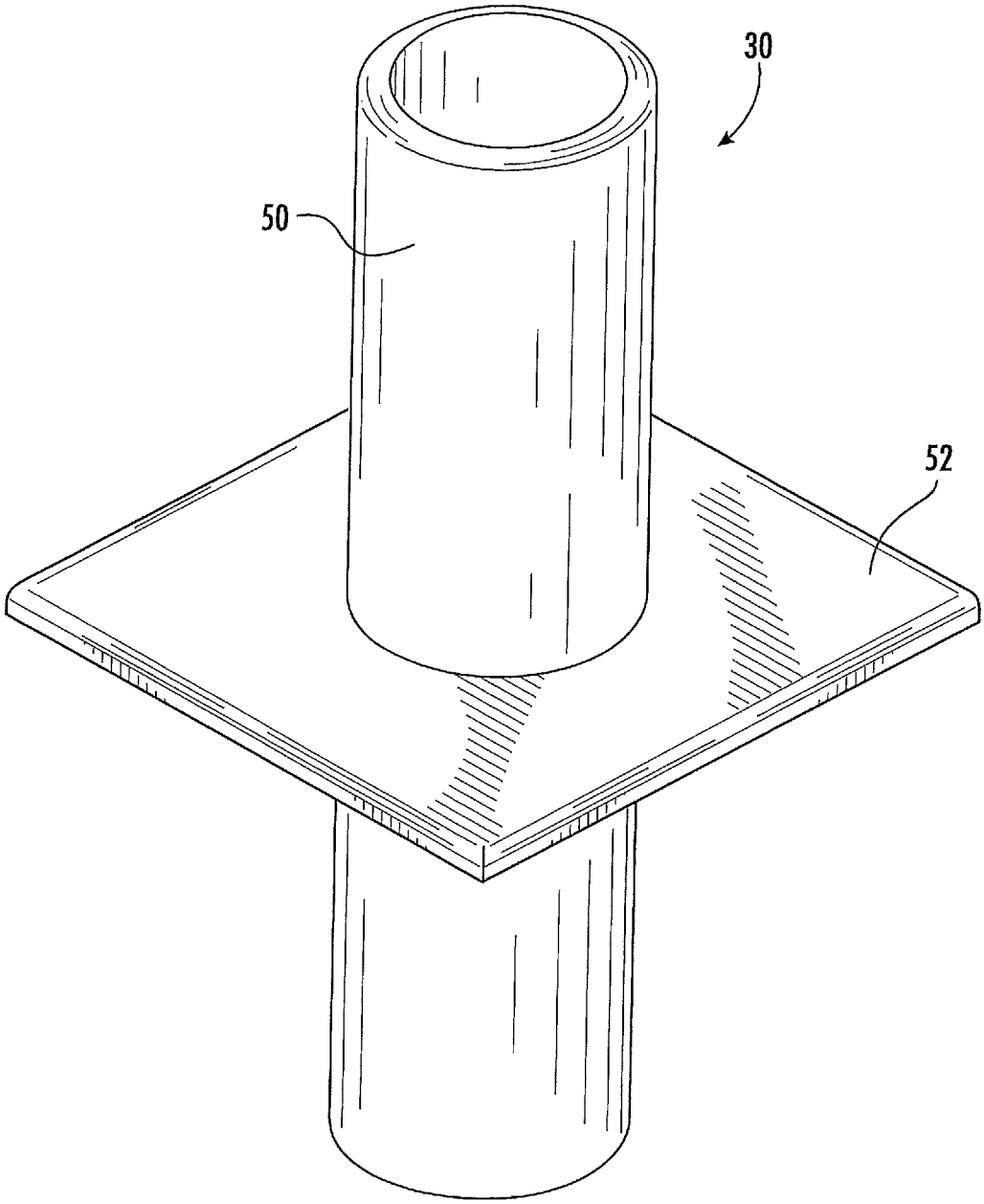
FIG. 9 is a perspective view of a pile guide.
Figure 10:
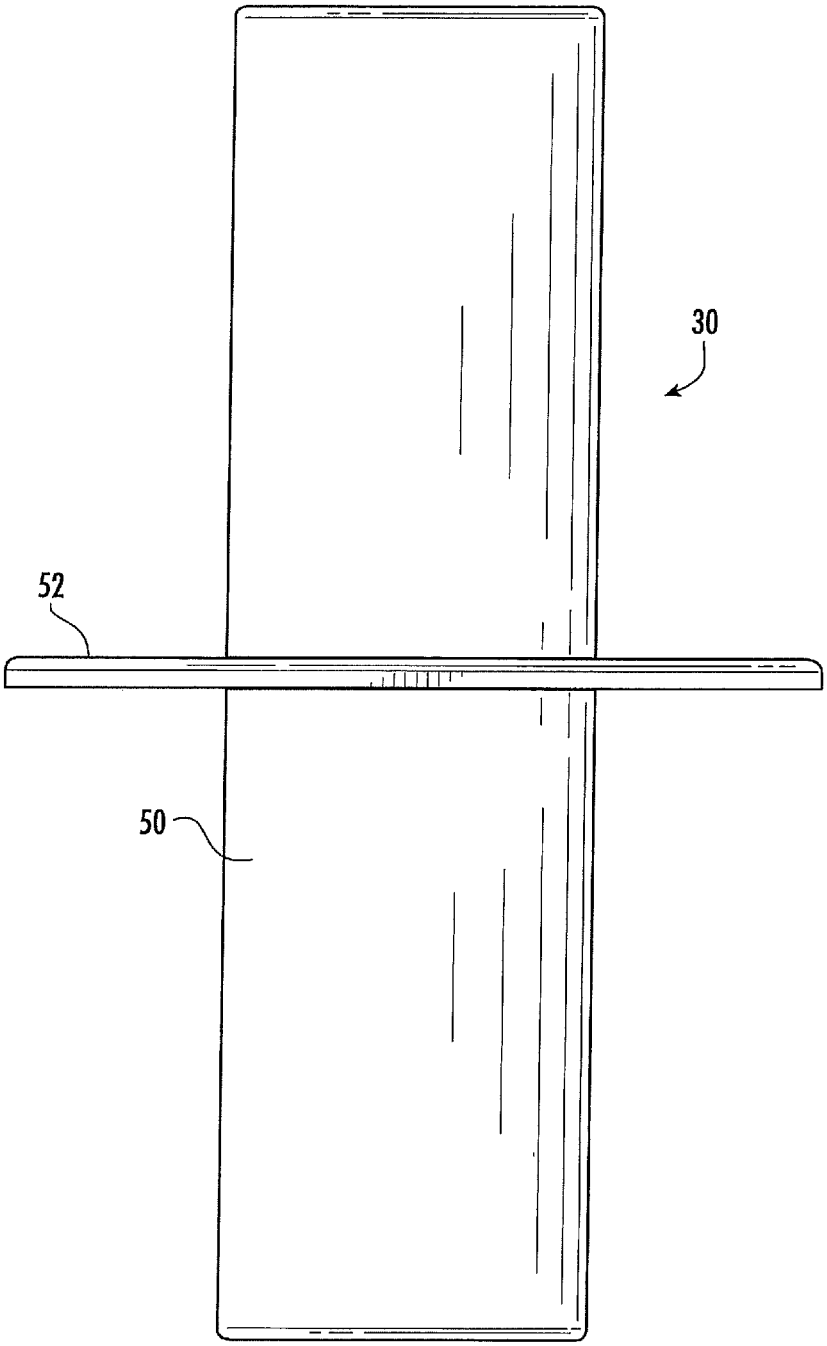
FIG. 10 is an elevation of the pile guide of FIG. 9.

In a preferred embodiment, the pile guides 30 are inserted through a void in the catwalk flotation tanks 20,22,120,121, 122,123. Preferred constructs of pile guides for this application are shown in FIG. 9 and FIG. 10. The pile guide is characterized by a generally vertical sleeve 50 from which a planar flange 52 extends. The catwalk flotation tanks are shown as having a void 64 formed into which the pile guides are poisoned and fastened, such as by welding. The flange limits the travel and assists in positioning the pile guide into the flotation tanks.

In a preferred embodiment, the pile guide is formed of HDPE, and formed by welding the sleeve to the flange. It has been found that welding the sleeve to the flange provides greater strength in forming the pile guide as a unitary member, although the pile guide may be formed as unitary member in some embodiments.

A void is formed in the flotation tanks 20,22 for the catwalk 4, preferably near ends of the flotation tanks of the catwalk, as shown in FIG. 1. The pile guides 30 are inserted into the void in the flotation tanks of the catwalk in a manner that allows removal of the pile guides in case maintenance of the pile guides is required due to breakage or wear. The flange 52 limits the travel of the pile guide into the void of the catwalk flotation tanks, with a portion of the pile guides extending above the flotation tanks in a preferred embodiment. The sleeve 50 of the pile guides accepts a pile that is driven into the earth and which fixes the catwalk or other object to the earth. Through the use of connecting guide constructs 32, the piles also position the boat lift, substantially negating horizontal movement of the boat lift but permitting free vertical movement of the boat lift.

It is preferred that the pile guides 30,32 and other components disclosed herein are formed of high density polyethylene (HDPE). High density polyethylene is extremely strong and can withstand substantial impact. Floating docks and pile guides used with them are subject to impact from boats and other objects. High density polyethylene is also abrasion resistant. Importantly, high density polyethylene exhibits a low coefficient friction; therefore, the sleeve of the device glides easily relative to the pile or similar securing object, whether the pile or object is constructed of wood, concrete or other materials. This feature is particularly important for applications wherein the associated floating dock is subject to frequent tidal changes or boat lift movement approaching two (2) meters or more. Further, because high density polyethylene is abrasion resistant, the sleeve is not subject to substantial wear over time as the pile moves within the opening or interior of the sleeve 50.

High density polyethylene can also be formed to be resistant to ultraviolet (UV) light such as sunlight. The addition of carbon black to high density polyethylene provides UV stability. Further, UV absorbers and light stabilizers (HALS) either alone or in combination with each other, and/or in combination with carbon black, may be added to the high density polyethylene to improve UV resistance and reduce UV deterioration.

The planar flange 52 may be formed from a sheet of high-density polyethylene. High density polyethylene may be cut or formed to the shapes shown in the drawing figures to form the planar flange. A hole or void may be cut or formed in the high-density polyethylene. Extruded high-density polyethylene pipe may be cut to form the sleeve 50. The sleeve may be welded in the hole or void of the planar flange to form the pile guides shown in the drawings.

While the sleeve 50 as shown in the drawings is cylindrical, it is not necessary that the sleeve have the circular cross section of a cylinder. The sleeve of the pile guide may be formed in other geometric shapes, such as rectangles or squares. The shape of the sleeve of the pile guide will typically depend upon the geometric shape of the cross section the pile on which it is mounted.

In another embodiment of the boat lift, elements of the boat lift and catwalk are formed as separate parts that permit the catwalk and boat lift to be assembled after the boat lift is transported to a destination for installation. Due to limitations of highway transportation, very wide and/or very long and previously assembled boat lifts and catwalks cannot be transported by truck.

Figure 11:
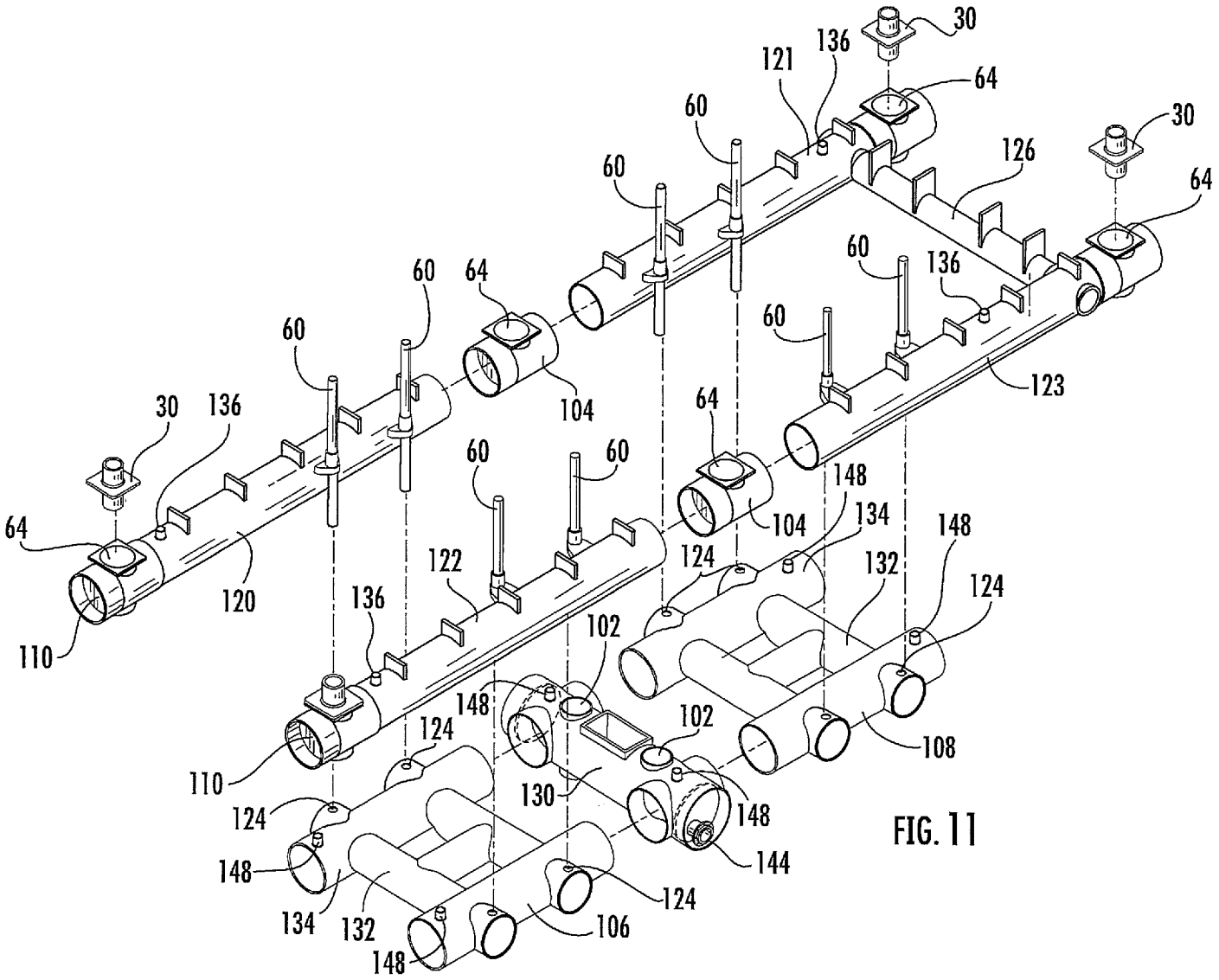
FIG. 11 is an exploded view of another embodiment of the boat lift and catwalk.
Figure 12:
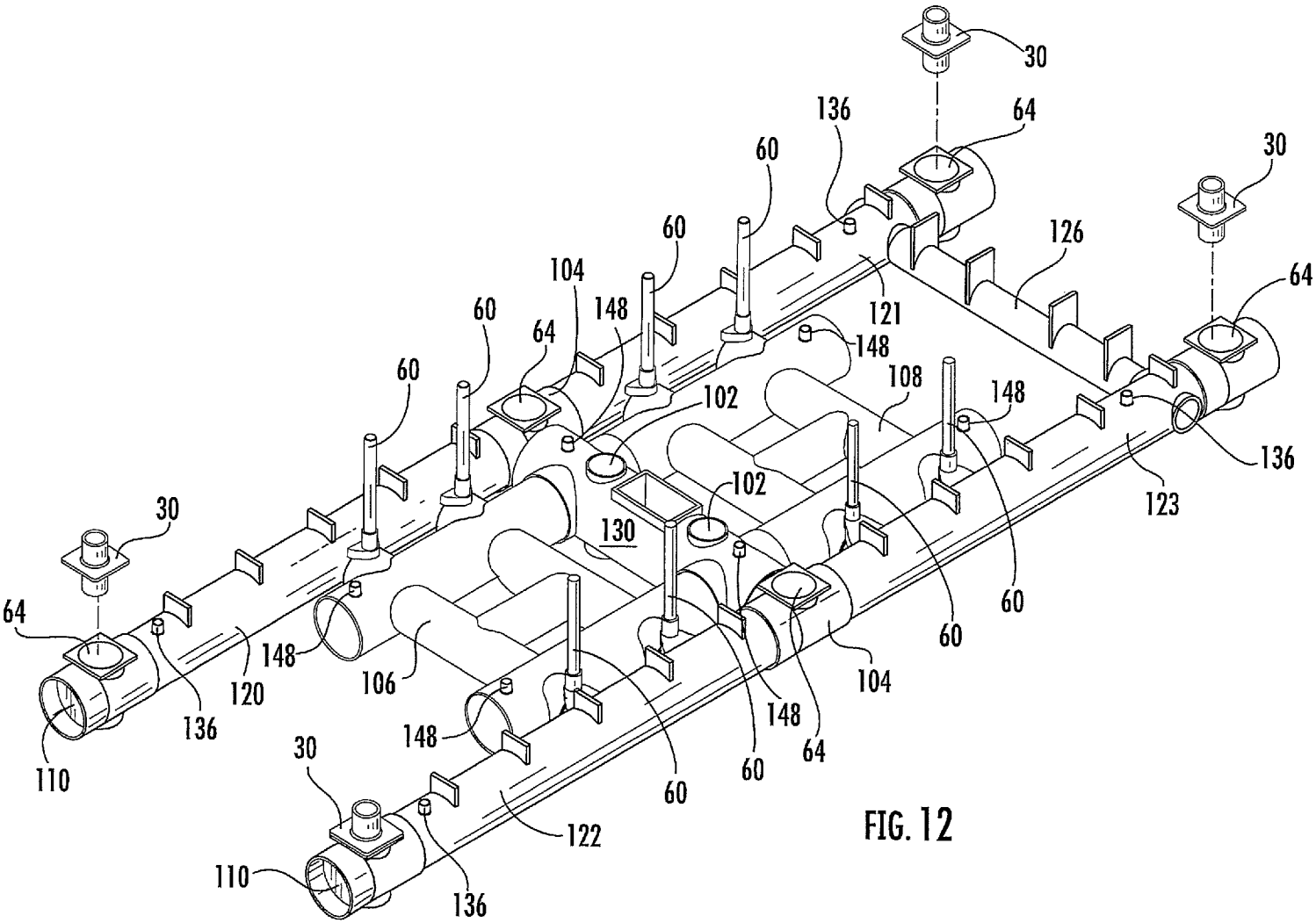
FIG. 12 is a perspective view of the boat lift and catwalk of FIG. 11.

FIG. 11 and FIG. 12 demonstrate a catwalk and boat lift that may formed in parts for later assembly after transportation of the parts to a site. This construction is referred to herein as a modular boat lift and modular catwalk. The longitudinal flotation tanks 120, 121, 122, 123 are formed in two or more pieces for each side of the catwalk, and the flotation tanks of the boat lift are formed as separate tank constructs 106, 108 for the boat lift.

Figure 13:
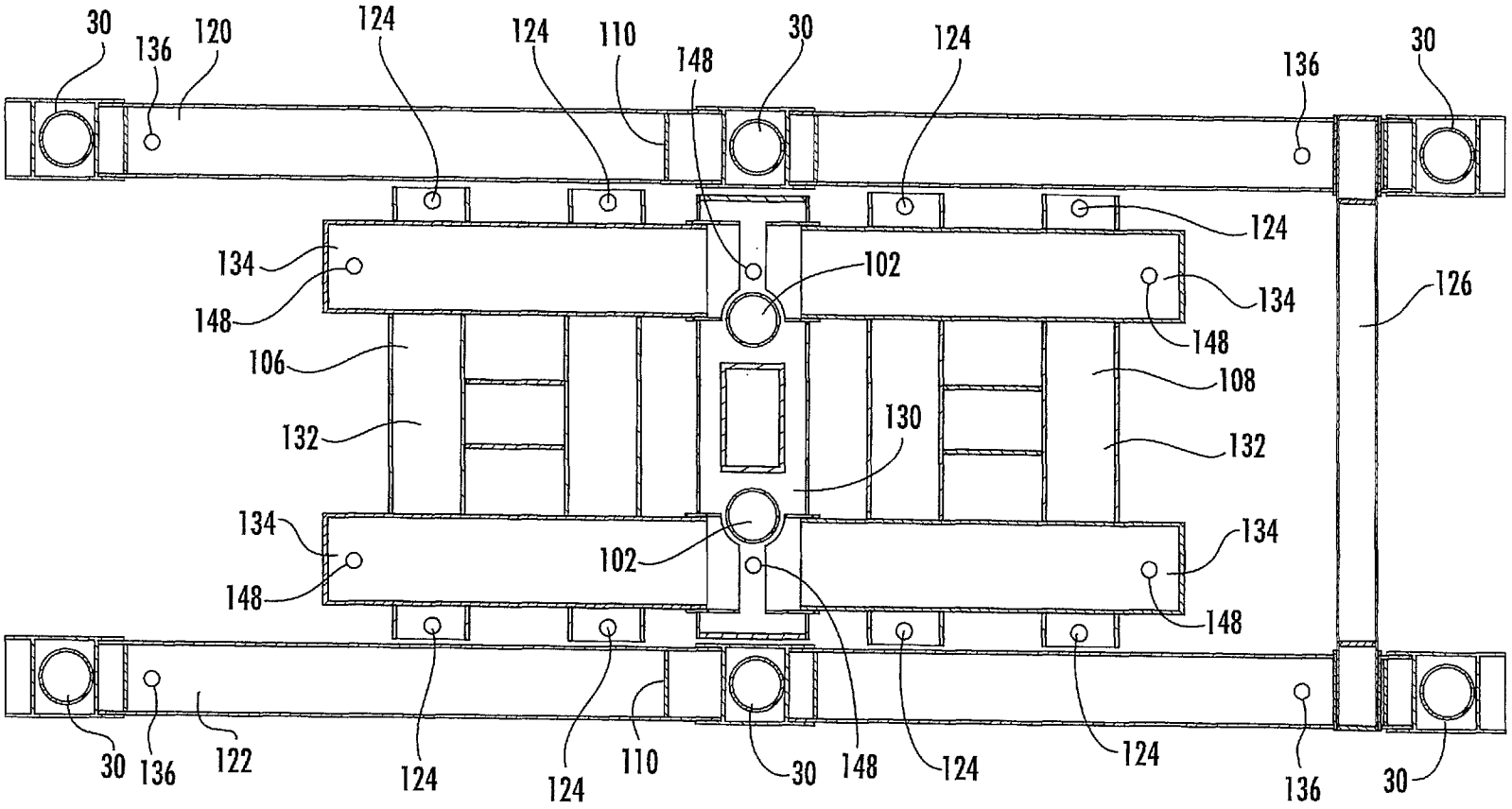
FIG. 13 is a top plan view of the of the boat lift and catwalk of FIG. 12.

In one embodiment, the longitudinal members are joined by inserting a connecting sleeve 104 to each end of the longitudinal flotation tanks 120, 121, 122, 123. As shown in FIG. 11 and FIG. 13, a plate 110 is present at or near the end of the longitudinal tanks. This plate is attached, such as by welding, to form a water seal in the end of the tanks. The flotation tanks are inserted into the inside diameter of the connecting sleeve to join the flotation tanks in a construct to support the catwalk. In another embodiment the connecting sleeve is inserted into the inside diameter of the flotation tanks to join the flotation tanks together. The sleeve is fixed to the floatation tanks, such as by welding. When the flotation tanks are formed of the preferred material, which is HDPE, the sleeve may be welded to the ends of the flotation tanks. The connection of the flotation tanks as described may be done after transportation of the individual parts of the boat lift and/or catwalk construct with assembly performed onsite where the boat lift and/or catwalk are installed.

The boat lift flotation tank constructs 106,108 each join a transverse flotation tank 130. In a preferred embodiment the transverse flotation tank comprises one or more pump receptacles 102. The transverse flotation tank is in water (hydraulic) communication with the flotation tank constructs. That is, the pumps 140 that are positioned in the transverse flotation tank pump water from the flotation tank constructs to cause the boat lift to float to the desired level. The transverse flotation tank in the embodiment shown has two (2) receptacles on each side that receive two (2) corresponding ends of the flotation tank constructs in hydraulic communication that permits water flow from tank to tank. FIG. 11, FIG. 12.

Figure 18:
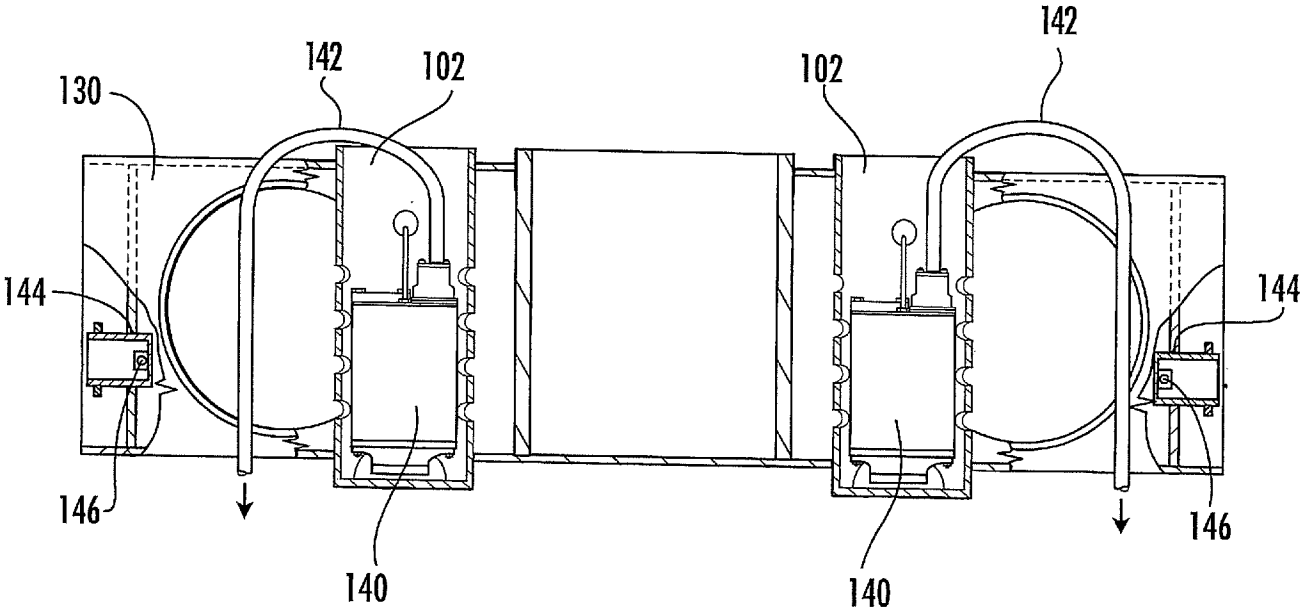
FIG. 18 is a side sectioned view of a transverse member of the boat lift.

The pumps 140 pump water from the transverse flotation tank 130 and the flotation tank constructs 106,108, which are in hydraulic communication with the transverse flotation tank. Water may be pumped out of the flotation tanks through lines such as lines 142. FIG. 18.

The transverse floatation tank 130 of the boat lift and may be produced to multiple desired lengths and kept in stock with pumps assembled in the transverse flotation tank. The transverse flotation tank may also comprise the valves 146 that prevent or allow water to flow into the boat lift flotation tanks 106,108,130. The transverse member or tank 126 of the catwalk may be produced in lengths that complement the transverse flotation tank 130, so that boat lifts of varying widths may be efficiently produced. The boat lift and catwalk can be assembled on site due to the modular construction, so that the resulting width of the boat lift and cat walk is not limited by the width of trucks that transport the tanks.

The boat lift flotation tank constructs 106,108 may be constructed to be assembled on site. For example, the flotation tank constructs may be formed of HDPE and the center or transverse members 132 welded to the outer or longitudinal members 134. It is preferred that the center members 132 and the outer members 134 are in hydraulic communication with each other and with the transverse flotation tank 130. Transportation of the boat lift by truck is not limited due to width, and the boat lift according to the invention may be made to many widths and lengths as required by the user.

In a preferred embodiment, the boat lift flotation tank constructs 106,108 and the transverse flotation tank 130 are formed of cylindrical members, such as cylinders formed of HDPE. The ends of the cylinders may have a wall positioned therein to form a water seal. The wall may be circular member welded or otherwise attached in the ends of each of the circular openings of the flotation tanks. The voids 124 are exterior to the water seals so that the voids do not hydraulically communicate with the tanks and cause leakage. The cylinders may have baffles inserted therein that regulate movement of water within the flotation tanks as they are flooded or evacuated, since movement of water that is too rapid may impact the balance of the boat lift. The baffles may be a series of vertical members positioned within the flotation tanks.

Similarly, one or more additional flotation tank constructs like 106,108 may be joined to one or more additional transverse flotation tanks 130 to obtain the overall required boat lift length. The width may be changed according to the width of the transverse flotation tanks.

The teachings of pile guides and connecting guide constructs for the boat lift and catwalk as described above and shown FIG. 1, FIG. 2 and FIG. 5 may also be applied to the modular boat lift and catwalk depicted in FIG. 11 and FIG. 12.

Figure 14:
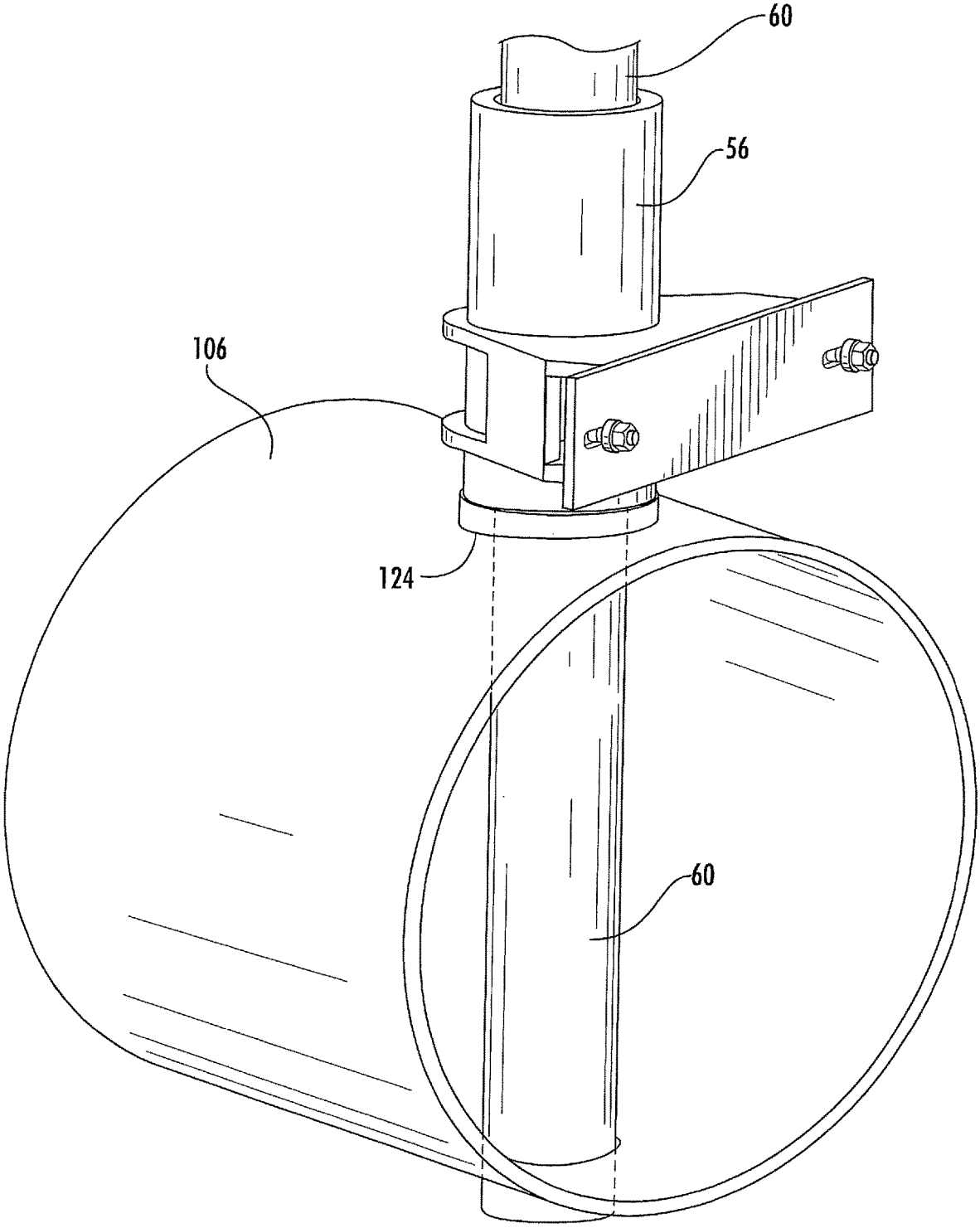
FIG. 14 is an isolation of connecting guide construct joining the boat lift.
Figure 15:
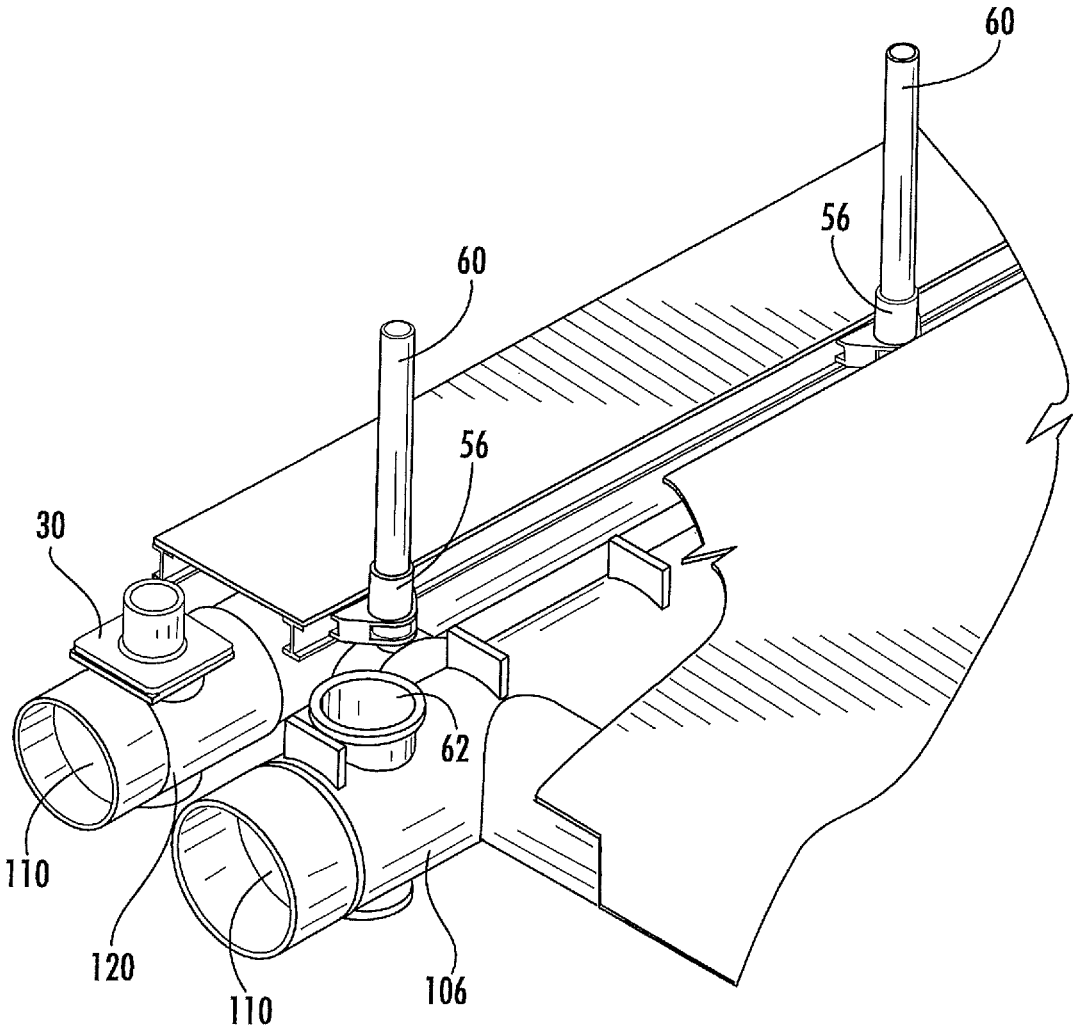
FIG. 15 is an isolation of flotation tanks for the catwalk and boat lift with a pile guide as shown in FIG. 10 in position in the catwalk flotation tank.

FIG. 14 shows another embodiment of a connecting guide construct. In this embodiment, the flotation tanks of the boat lift 106,108 have voids 124 formed near an end thereof that is adjacent to the catwalk for receiving the connecting guide construct. FIG. 12; FIG. 13. The voids as shown are vertical voids. The voids are outside of the water receiving portion of the flotation tank constructs 106,108. The voids are exterior to water seals of the flotation tank constructs.

A stanchion 60, which may be formed of aluminum or stainless steel, is inserted into the void 124 of the boat lift flotation tanks 106,108, as demonstrated by FIG. 14, and fixed to the flotation tanks in one embodiment. An upper guide 56 as described herein accepts the stanchion therein and permits vertical travel of the boat lift relative to the catwalk or other fixed object but negates or minimizes horizontal movement of the boat lift. The boat lift can move up and down relative to the upper guide that is mounted to a floating catwalk, or to a fixed object, such as a bulkhead or pile or seawall. FIG. 14 shows the upper guide 56 mounted to a flotation tank 106 or 108 of a catwalk, with a stanchion 60 inserted and affixed to the boat lift. As with other guides disclosed herein, the upper guide is preferred to be formed of HDPE.

Figure 16:
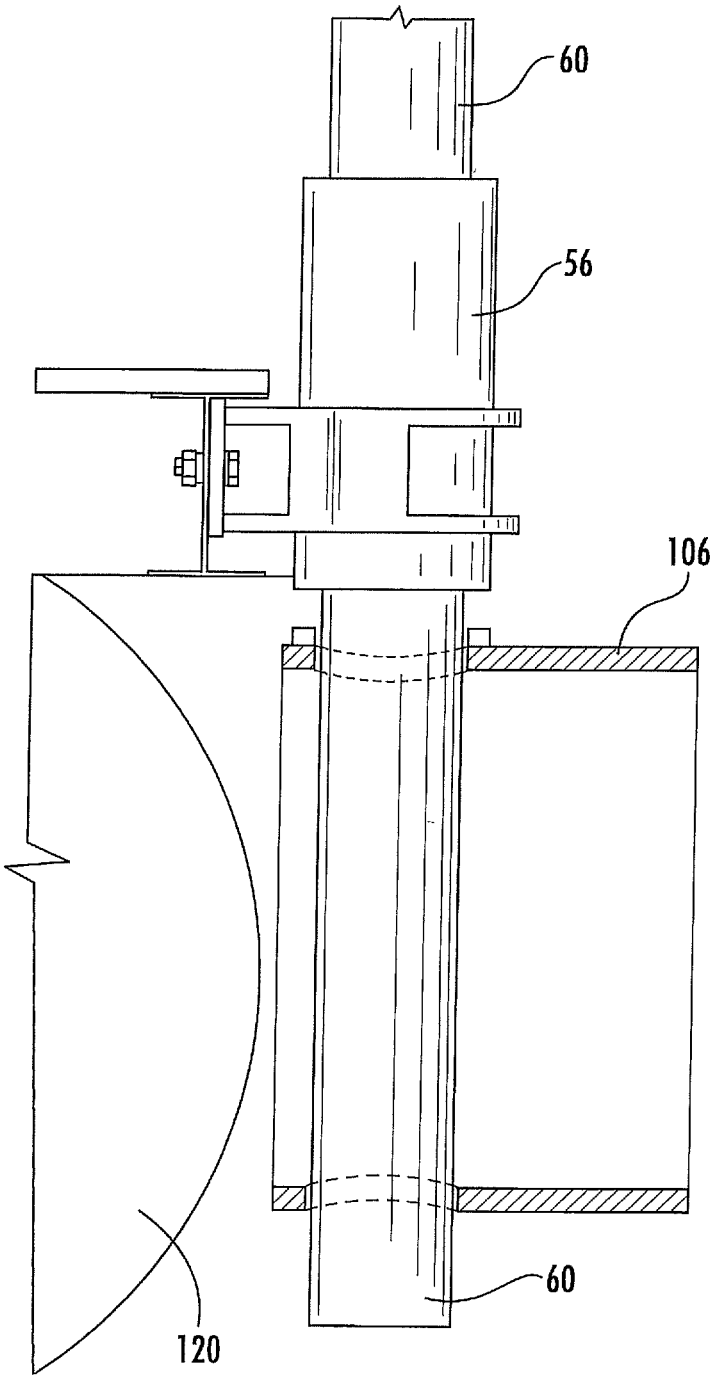
FIG. 16 is a side elevation of a connecting guide construct demonstrating connection of a catwalk to a flotation tank of a boat lift.
Figure 17:
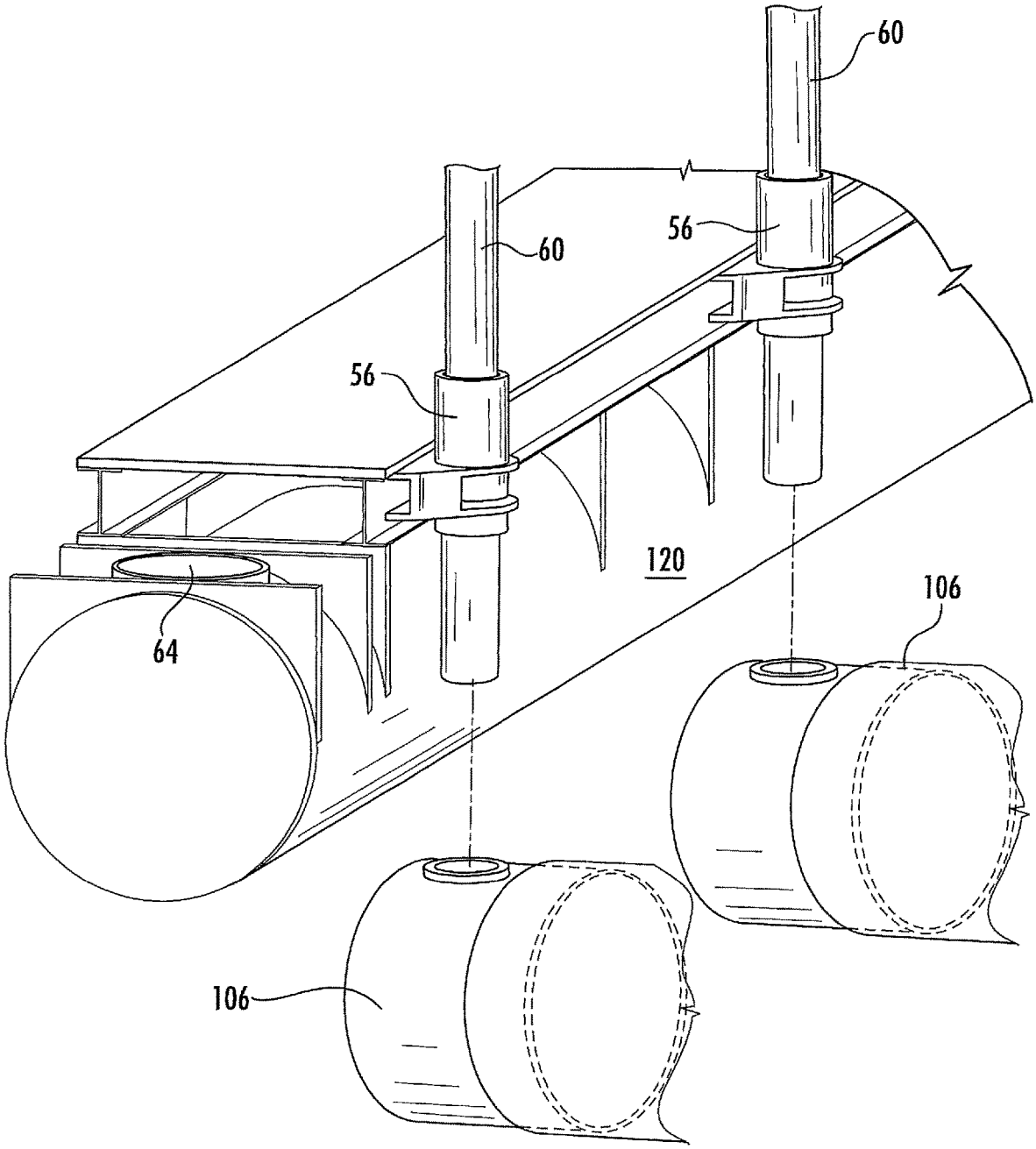
FIG. 17 is a perspective view of connecting guide constructs of FIG. 14 and demonstrating connection of a catwalk to flotation tanks of a boat lift.

FIG. 16 demonstrates a variation of the connecting guide construct of FIG. 14, wherein the stanchion 60 is driven as a pile and fixed into the earth. In this embodiment, the flotation tank 106 of the boat lift is not fixed to the stanchion, but vertical movement is permitted relative to the stanchion, as the guide 56 is also permitted vertical movement. As described above, the size of the stanchion relative to the sleeve in the upper guide 56 and the opening in the flotation tank of the boat lift permit vertical movement of the boat lift and the catwalk, while negating horizontal movement from wave action, wind or other forces. It is preferred that at least two connecting guide constructs are associated with each flotation tank 106,108 of the boat lift.

The preferred catwalks are supported by longitudinal flotation tanks 120,121,122,123. The longitudinal flotation tanks 121,123 may be connected by a transverse tank 126. The flotation tanks for the catwalk 120,121,122,123 are water tight but provide a water inlet 136 and/or outlet for filling the tanks or withdrawing water from the tanks. During construction and/or positioning of the boat lift, catwalks are positioned alongside the boat lift construct (which comprises 106, 108 and 130 in the embodiment shown in the drawings). The flotation tanks are filled with water to a level of the flotation tanks that holds the catwalk in the desired floating position relative to the boat lift construct, so that the top decking 26 of the catwalks, which may be covered similarly or identically to the boat lift frame, are at the desired position relative to the decking of the boat lift when the boat lift is raised to its maximum vertical position. Once the water level in the flotation tanks of the catwalks is sufficient to hold the catwalk in the desired position, it should not be necessary to frequently adjust the flotation tanks' water level. In a preferred embodiment, when the boat lift has lifted the boat to the full upper position, so that the hull of the boat is out of the water, the decking of the boat lift, where it joins the catwalk, and the decking of the catwalk will be relatively even each with the other and above the water line. Occupants of the boat may ingress and egress the boat by traversing the catwalk, without the decking of any of these elements presenting a tripping hazard.

The force of gravity holds openings 144 that communicate with the transverse flotation tank 130 and the boat lift flotation tanks 106, 108 below the water line. Water enters the flotation tanks when valves 146 that communicate with the openings 144 in the flotation tanks of the boat lift are open. The valves may be controlled by one or more actuators. The actuator(s) are preferred to be pneumatically controlled with an air compressor providing air pressure for actuating the valve by means of the actuator. Operation of the valves, and therefore filling of the flotation tanks, may further be controlled by a timer, or by a water level sensor. When the flotation tanks are filled with water, the boat lift construct, and any associated boat or vessel, is submerged to a depth that allows the boat to float over the boat lift. The boat may be driven on or off of the boat lift and any decking of the boat lift. In one embodiment, an inlet, valve and actuator are positioned at opposite ends of the transverse flotation tank 130 so that water enters the boat lift in a balanced manner relative to flotation tank constructs 106, 108 that receive water from the transverse flotation tank.

Air vents 148 communicate with air vent lines. Each air vent has a valve associated with it, and the valve may also have an actuator that operates the valve to a fully opened or fully closed or partially open or partially closed position. The actuator may be pneumatically operated and controlled. By controlling the rate of flow of air out of the air vent, the rate of submersion of the boat lift can be controlled as the submerged openings to the flotation tanks are opened to flood the flotation tanks. In a preferred embodiment, the openings into the flotation tank are of sufficient size to allow the boat lift to travel from fully raised to fully submerged in less than one minute. However, by limiting the degree of opening of the air vents, and thereby limiting the rate of flow of air out of the flotation tanks, the rate of water entering the flotation tanks through the openings, and therefore the rate of submersion, may also be controlled, and accelerated or reduced as preferred.

The boat lift is raised by evacuating water from the flotation tanks 106,108 and replacing the water with air. In a preferred embodiment, evacuation of the water is performed by pumping the water from the flotation tanks, using one or more water pumps 140. To accomplish water evacuation from the flotation tanks, the valves that associated with water inlets to the floatation tanks are closed, such as by the actuators. Water is pumped from the flotation tanks through water pump out lines 142 that communicate with each of the flotation tanks. The air vents 148 are opened to replace water that is being pumped from the flotation tanks with air.

While raising the boat lift during the water evacuation process, the air vents 148 remain open so that air replaces water that is evacuated. The water flow rate may be regulated by partially closing valves associated with the air vents. However, in most cases, the air vents will remain fully open, since rapid evacuation of water, and the associated lifting action, is desired to occur relatively rapidly. Sensors may be provided so that when there is no water flow to the water pumps, or an individual pump of a plurality of water pumps, operation of the pump or pumps is terminated.

In a preferred embodiment, a central control panel for operating the boat lift is provided. The control panel may have a simple command selector to raise or lower the boat lift. Other controls may control the rate of flow of water and/or air in and out of the flotation tanks by operation of the valves as discussed herein. In other embodiments, manual controls for actuating the pumps or terminating operations of the pumps may be provided.

In a preferred embodiment, submersible pumps 140 are positioned in the transverse flotation tank 130 to communicate with the flotation tanks 106,108. Pumps 140 may be inserted and retained in a pump receptacle 102 that houses each pump. FIG. 18. The submersible pumps are preferably positioned so as to balance the flotation tank construct, and also to remove water relatively uniformly from the flotation tank construct, thereby maintaining balance during the process of pumping water from the flotation tank construct. The submersible pumps may be submersible pumps such as those manufactured by Gorman-Rupp.

In one embodiment, the water receiving inlet or inlets 144 are positioned near the center of the flotation tank construct. The water receiving inlets are preferred to communicate with the flotation tanks 106,108. By positioning the water receiving inlets in this embodiment near the center of the flotation tank construct, such as near the generally centralized transverse flotation tank 130, water enters the flotation tank construct near the center thereof, balancing the boat lift construct as it fills with water.

Opening and closing of the water receiving inlets 144 that communicate with the flotation tanks 106,108 is preferred to be formed by a valve 146 for each inlet. The valves may be remotely controlled and may be electrically, hydraulically or pneumatically actuated. The valves and electric actuator may be those such as those manufactured by ROTORK.

Flotation of the boat lift of the embodiment of the invention shown in FIGS. 1-4 operates in the same fashion as the embodiment of FIGS. 11-13. Water is pumped from the flotation tanks 6,8 by pumps that may be located in one or more of housings 62. Regulated openings or inlets allow water to enter the tanks, with vents provided to equalize air pressure as described above.

In the preferred embodiment, flotation tanks for the boat lift and the catwalks are constructed of high density polyethylene (HDPE) and may be formed of HDPE pipe. HDPE components may be joined by welding or fusing methods for HDPE.

Optionally, or additionally, water receiving inlets may be positioned near an end of the flotation tank construct. Positioning water receiving inlets at the end of these flotation tanks may be preferred where water is shallow and the bottom of the body of the water slopes upwardly from the rear of the boat lift toward the front of the boat lift. The water receiving inlets may have electrically actuated valves.

In use, the boat lift flotation tank construct (includes 106,108,130) is partially or completely filled with water to increase specific gravity so that the boat lift is below the water line. A boat may be driven or otherwise positioned onto the deck of the boat lift. After the boat is secured in position on the boat lift the water receiving inlets 144 are closed, such as by actuation of the valves 146. The submersible pumps are actuated, and water is pumped from the flotation tank construct. Air enters the flotation tank construct through the air vents to replace the water. The air vents are preferred to be above the water line when the boat lift is submerged.

As water is expelled from the boat lift flotation tank construct and air enters the flotation tank construct, the boat lift construct floats. The submersible pumps 140 are actuated until the boat lift reaches the desired level, which is typically after the bottom of the boat is completely above the water line, and the boat is at a level such that entering and exiting the boat by means of the catwalks is convenient.

The boat may subsequently be lowered for use by opening the valves 146 to the water receiving inlets 144 and allowing water to enter the flotation tank construct. The boat lift is submersed sufficiently to allow a boat positioned on the boat lift to float above the boat lift and exit the boat lift. In one embodiment, submersible pumps are used that reverse the flow of water so as to pump water into the flotation tank construct to rapidly flood the flotation tank construct.

What is claimed:

1. A boat lift, comprising:

a boat lift construct constructed and arranged to receive a boat hull on an upper surface thereof, the boat lift construct comprising;

a first flotation tank construct, a second flotation tank construct, a transverse tank set crosswise between the first flotation tank construct and the second flotation tank construct, and a pump positioned within the transverse tank, wherein the first flotation tank construct and the second flotation tank construct are in hydraulic communication through the transverse tank, and wherein the pump is constructed and arranged to remove water from the first flotation tank construct and the second flotation tank construct, wherein the boat lift construct comprising the first flotation tank construct, the second flotation tank construct and the transverse tank is configured to lower the boat hull by submerging the boat lift tank construct by flooding the boat lift construct and to raise the boat hull by lifting the boat lift construct by the pump pumping water from the boat lift construct.

2. A boat lift as described in claim 1, wherein the first flotation tank construct comprises a vertical void extending through a side of the first flotation tank construct, and wherein the void is exterior to a water seal of the first flotation tank construct, the vertical void constructed and arranged to receive a pile therein.

3. A boat lift as described in claim 1, the first flotation tank construct comprising a first longitudinal tank and a second longitudinal tank, the first longitudinal tank comprising a vertical void extending through a side of the first longitudinal tank, and the second longitudinal tank comprising a vertical void extending through a side of the second longitudinal tank, wherein the vertical void of the first longitudinal tank is exterior to a water seal of the first longitudinal tank, and wherein the vertical void of the second longitudinal tank is exterior to a water seal of the second longitudinal tank, and the vertical voids are constructed and arranged to receive a pile therein.

4. A boat lift as described in claim 3, further comprising a valve that communicates with the boat lift construct, wherein the pump removes water from the first flotation tank construct and the second flotation tank construct and the pump provides flotation of the tank construct when the valve is positioned to prevent a flow of water into the tank construct.

5. A boat lift as described in claim 3, further comprising a catwalk that is positioned along a length of the boat lift construct, wherein the catwalk comprises a tank constructed and arranged to receive water therein, the tank comprising a water inlet and a water outlet for regulating a water level in the tank and thereby regulating a flotation height of the catwalk.

6. A boat lift as described in claim 3, further comprising a catwalk that is positioned along a length of the boat lift construct, wherein the catwalk comprises a first tank constructed and arranged to receive water therein, and a second tank constructed and arranged to receive water therein, wherein the first tank and the second tank are joined by a connecting sleeve, and wherein the connecting sleeve comprises a vertical void therein that is constructed and arranged to receive a pile therein.

7. A boat lift as described in claim 6, further comprising a second catwalk that is positioned opposite the first catwalk and along a length of the boat lift construct, wherein the second catwalk comprises a first tank constructed and arranged to receive water therein, and a second tank constructed and arranged to receive water therein, wherein the first tank and the second tank of the second catwalk are joined by a connecting sleeve, and wherein the connecting sleeve comprises a vertical void therein that is constructed and arranged to receive a pile therein.

8. A boat lift as described in claim 7, further comprising a tank that is connected at one end to the first catwalk and is connected at an opposite end to the second catwalk, and wherein the tank comprises a hook on an end thereof that engages the first catwalk.

9. A boat lift as described in claim 7, wherein the vertical void comprises a sleeve positioned in the vertical void that forms a pile guide.

10. A boat lift as described in claim 9, wherein the vertical void comprises a sleeve positioned in the vertical void that forms a pile guide.

11. A boat lift as described in claim 9, wherein the vertical void comprises a sleeve positioned in the vertical void that forms a pile guide and wherein the sleeve comprises polyethylene.

12. A boat lift as described in claim 7, wherein the vertical void comprises a sleeve positioned in the vertical void that forms a pile guide, and wherein the sleeve comprises polyethylene.

13. A boat lift as described in claim 1, further comprising a catwalk that is positioned along a length of the boat lift construct, wherein the catwalk comprises a tank constructed and arranged to receive and hold water therein, and wherein the tank comprises a water seal at an end of the tank, the tank comprising a void extending through the tank and exterior to the water seal, and wherein the vertical void is constructed and arranged to receive a pile therein.

14. A boat lift as described in claim 1, further comprising a catwalk that is positioned along a length of the boat lift construct, the catwalk comprising a boat lift connector on a side of the catwalk, the boat lift connector comprising a sleeve, wherein the first flotation tank construct comprises a vertical void extending through a side of the first flotation tank construct, and wherein a pile extends through the sleeve and the vertical void and connects the boat lift construct to the catwalk.

15. A boat lift as described in claim 1, further comprising a catwalk that is positioned along a length of the boat lift construct, the catwalk comprising a boat lift connector on a side of the catwalk, the boat lift connector comprising a sleeve, wherein the first flotation tank construct comprises a stanchion extending vertically above the first flotation tank construct, and wherein the stanchion slidably engages the sleeve.

16. A boat lift as described in claim 15, wherein the sleeve comprises polyethylene.

17. A boat lift as described in claim 16, wherein the sleeve comprises polyethylene.

18. A boat lift as described in claim 3, further comprising a tank that is in hydraulic communication with the first flotation tank construct and the second flotation tank construct.

* * * * *